US005995048A

United States Patent [19]

Smithgall et al.

[11] Patent Number: 5,995,048

[45] Date of Patent: Nov. 30, 1999

[54] QUARTER WAVE PATCH ANTENNA

[75] Inventors: David Harry Smithgall, East Windsor; Gregory Alan Wright, Fair Haven, both of N.J.

[73] Assignee: Lucent Technologies Inc., Murray Hill, N.J.

[21] Appl. No.: 08/866,935

[22] Filed: May 31, 1997

Related U.S. Application Data

[60] Provisional application No. 60/018,719, May 31, 1996.

[51] Int. Cl.[6] ..... H01Q 3/02; H01Q 9/28

[52] U.S. Cl. ..... 343/700 MS; 343/795

[58] Field of Search ..... 343/700 MS, 702, 343/846, 795; 455/38.2; 342/359

[56] References Cited

U.S. PATENT DOCUMENTS

| | | | |
|---|---|---|---|
| 4,644,361 | 2/1987 | Yokoyama | 343/700 MS |
| 4,700,194 | 10/1987 | Ogawa et al. | 343/700 MS |
| 5,124,733 | 6/1992 | Haneishi | 343/700 MS |
| 5,216,430 | 6/1993 | Rahm et al. | 343/700 MS |
| 5,649,296 | 7/1997 | McLellan et al. | 455/38.2 |
| 5,737,369 | 4/1998 | Retzer | 375/346 |
| 5,771,021 | 6/1998 | Veghte et al. | 343/700 MS |

*Primary Examiner*—Don Wong
*Assistant Examiner*—Jennifer H Malos
*Attorney, Agent, or Firm*—Samuel R. Williamson; Daniel J. Piotrowski

[57] ABSTRACT

An antenna design for a tag operating in an radio frequency identification system minimizes the influence of reflecting surfaces upon the antenna radiation pattern. The antenna advantageously provides near uniform performance when the tag is in varying proximity to different metal reflecting surfaces. The antenna operates as a quarter wave patch antenna and is constructed from a rectangular metal patch separated from a larger metallic plane. This metallic plane serves as the reference ground plane for a circuit attached to the antenna, with a direct short between the patch and the ground plane along one edge of the patch. The dimensions of the metal patch are selected such that one quarter of a wavelength of incident radiation forms a standing wave on the antenna. A careful choice of dielectric material and lateral dimensions determine the bandwidth of the antenna. The presence of the ground plane serves as a natural advantageous plane of isolation between energy radiated from the patch antenna and otherwise reflecting surfaces which may be brought into proximity with this antenna.

11 Claims, 4 Drawing Sheets

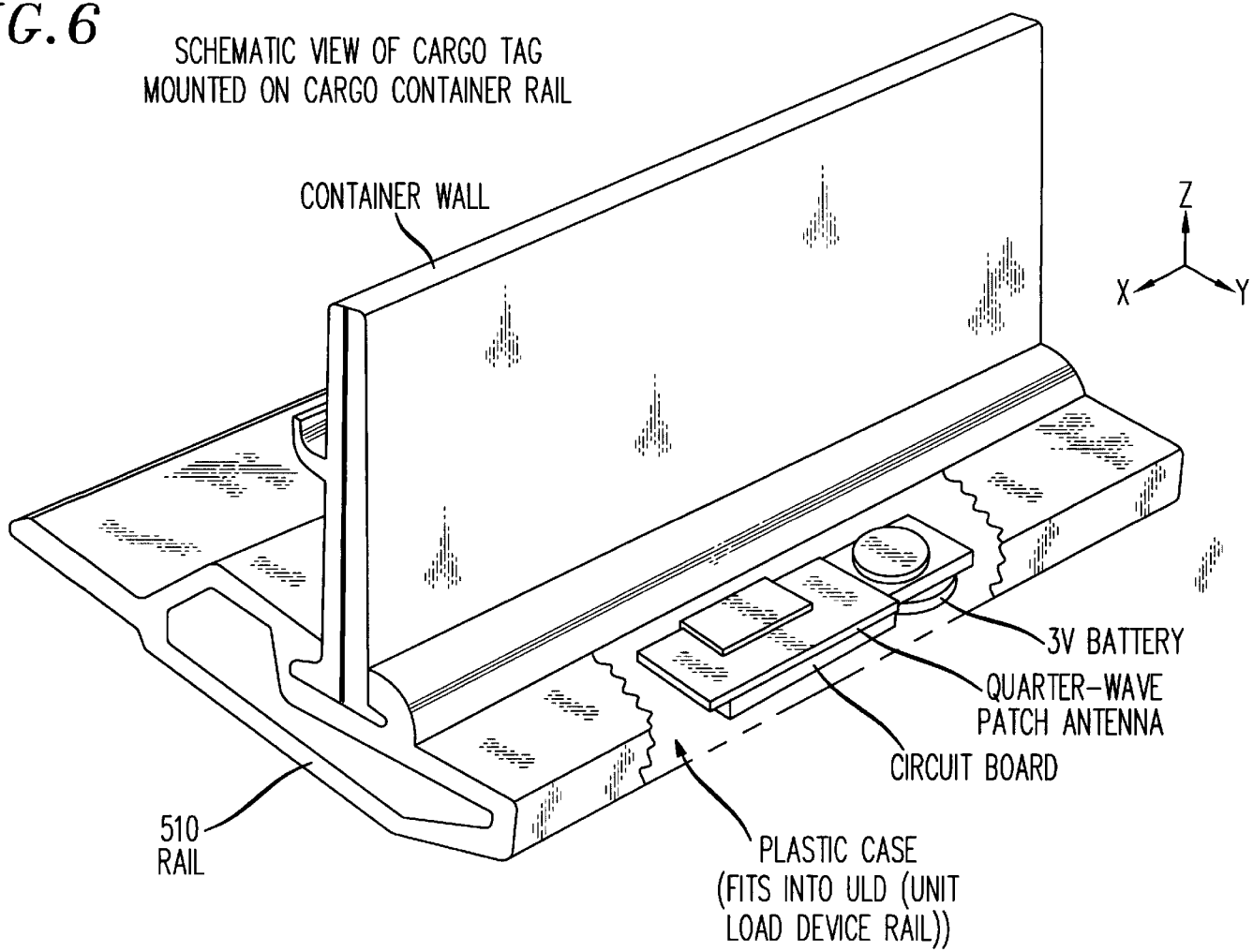
FIG. 6 SCHEMATIC VIEW OF CARGO TAG MOUNTED ON CARGO CONTAINER RAIL

QUARTER WAVE PATCH ANTENNA

RELATED APPLICATIONS

This application claims the benefit of Provisional Application Ser. No. 60/018,719 filed on May 31, 1996 and entitled "Quarter-Wave Patch Antenna for a Radio Frequency Identification Tag". Also, related subject matter is disclosed in the following applications assigned to the same Assignee hereof: U.S. patent application Ser. No. 08/775694, entitled "QPSK Modulated Backscatter System", and U.S. patent application Ser. No. 08/492173, entitled "Dual Mode Modulated Backscatter System."

FIELD OF THE INVENTION

This invention relates to wireless communication systems and, more particularly, to the use of a quarter wave patch antenna design which improves the performance of the system and reduces the sensitivity of the system to environmental factors.

BACKGROUND OF THE INVENTION

Radio frequency identification (RFID) systems are used for identification and/or tracking of equipment or inventory such as pallets, trucks, dollies or boxes or even the whereabouts of some animals, such as livestock in certain situations. These RFID systems are radio communication systems in which communications is provided between a radio transceiver, or interrogator, and a number of small, identifying labels or tags. These tags are read while in the radiation pattern or field of the interrogator, which may be connected to a computer-based tracking system. The intent of an RFID system is to provide a reliable and secure architecture that meets a predetermined performance requirement, while minimizing the cost of the interrogator and the tags. In the operation of RFID systems, the interrogator transmits to the tags using modulated radio signals, and the tags respond by transmitting modulated radio signals back to the interrogator. Specifically, the interrogator first transmits an amplitude modulated signal to the tag. Next, the interrogator transmits a continuous-wave (CW) radio signal to the tag. The tag then modulates the CW signal using modulated back scattering (MBS) wherein the antenna is electrically switched, by the tag's modulating signal, from being an absorber of radio frequency (RF) radiation to being a reflector of RF radiation; thereby encoding the tag's information onto the CW radio signal. The interrogator demodulates the incoming modulated radio signal and decodes the tag's information message.

The performance of an RFID system and, more specifically, a tag within such system is influenced by its surrounding environment An antenna in the tag, which is optimized for operation without nearby reflectors or dielectric absorbers, will not perform as effectively when those influences are near. Thus, system performance and sensitivity can be strongly affected by variations in the environment.

Many antenna configurations have been proposed for use in tags that operate in RFID systems. Some of these configurations are described in the following U.S. Pat. Nos. 4,853,705 (Landt); 4,816,839 (Landt); 4,782,345 (Landt); 4,724,443 (Nysen); and 5,394,159 (Schneider). Most of these configurations are dipole antennas, or tapered antennas which radiate from both sides of a tag containing such an antenna. These radiation patterns are therefore significantly altered when the tag is placed in close proximity to a reflecting or absorbing surface. For example, Nysen, in U.S. Pat. No. 4,724,443, proposes a patch antenna that has a quarter-wave strip line feed element. However, this configuration is complex, expensive to fabricate, and requires three levels of metallization. Although Schneider, in U.S. Pat. No. 5,294,159, describes a patch antenna design with only two layers of metalization and also describes a technique to match the antenna to a demodulating circuit, Schneider is not concerned with the problem of how the performance of a tag is affected by its surrounding environment. It is therefore desirable to provide in a tag an antenna that produces a near uniform performance irrespective of variations in those environments in which the tag operates.

SUMMARY OF THE INVENTION

In accordance with the invention, an antenna design for a tag operating in an radio frequency identification system minimizes the influence of reflecting surfaces upon the antenna radiation pattern. The antenna advantageously provides near uniform performance when the tag is in varying proximity to different metal reflecting surfaces.

In accordance with an aspect of the invention, the antenna operates as a quarter wave patch antenna and is constructed from a rectangular metal patch separated from a larger metallic plane. This metallic plane serves as the reference ground plane for a circuit attached to the antenna, with a direct short between the patch and the ground plane along one edge of the patch. The dimensions of the metal patch are selected such that one quarter of a wavelength of incident radiation forms a standing wave on the antenna. A careful choice of dielectric material and lateral dimensions determine the bandwidth of the antenna. The presence of the ground plane serves as a natural advantageous plane of isolation between energy radiated from the patch antenna and otherwise reflecting surfaces which may be brought into proximity with this antenna

BRIEF DESCRIPTION OF THE DRAWINGS

The invention and its mode of operation will be more clearly understood from the following detailed description when read with the appended drawing in which:

FIG. 6 shows a radio frequency identification tag located in a metal rail in a cargo application, in accordance with the invention.

Figure 1:
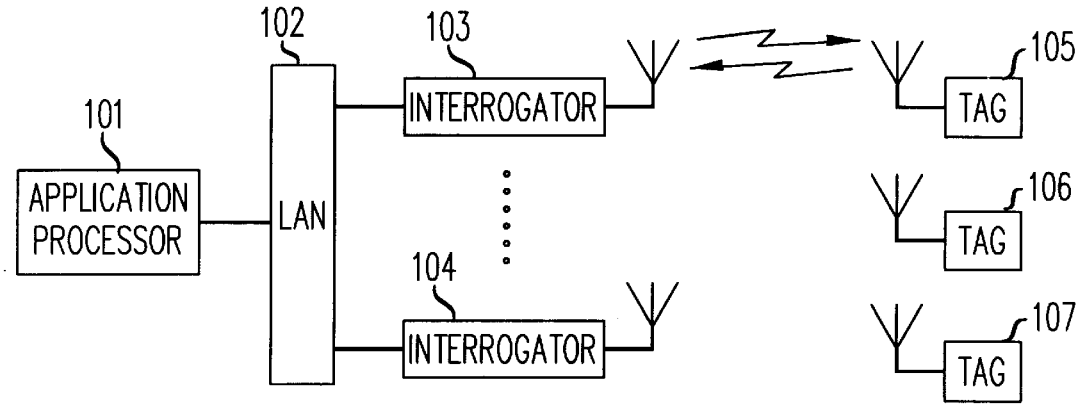
FIG. 1 is shows a block diagram of an illustrative radio frequency identification system.

Throughout the drawing, the same element when shown in more than one figure is designated by the same reference

Detailed Description

Referring now to FIG. 1, there is shown an overall block diagram of an illustrative radio frequency identification (RFID) system useful for describing the application of the present invention. An application processor 101 provided the function of a computer-based tracking system and communicates over a local area network (LAN) 102 to a plurality of interrogators 103–104. Each of the interrogators may communicate with one or more of read/write tags 105–107. For example, the interrogator 103 may receive an information signal, typically from an application processor 101, for one of the tags 105–107. The interrogator 103 takes this information signal and processor 200, shown in FIG. 2, properly formats a downlink message (information signal 200*a*) to be sent to the designated tag.

One class of RFID applications involves using RFID technology to read information from a tag affixed to a container or pallet. Such an application is set forth in IATA Recommended Practice RP 1640, International Air Transport Association Cargo Services Conference Resolutions Manual, 16th Edition, Oct. 1, 1993. In this application, the container is moved across the reading field of an interrogator, which is that volume of space wherein successful communications between the tag and the interrogator can take place. While the tag is in the reading field, the interrogator and tag must complete their information exchange before the tag moves out of the interrogation field. Since the tag often may be moving quickly through the reading field, the RFID system may have only a limited amount of time to successfully complete the transaction. In accordance with the invention, a communication protocol advantageously controls communication between the interrogator and one or more tags for effectively reading of these tags.

Figure 2:
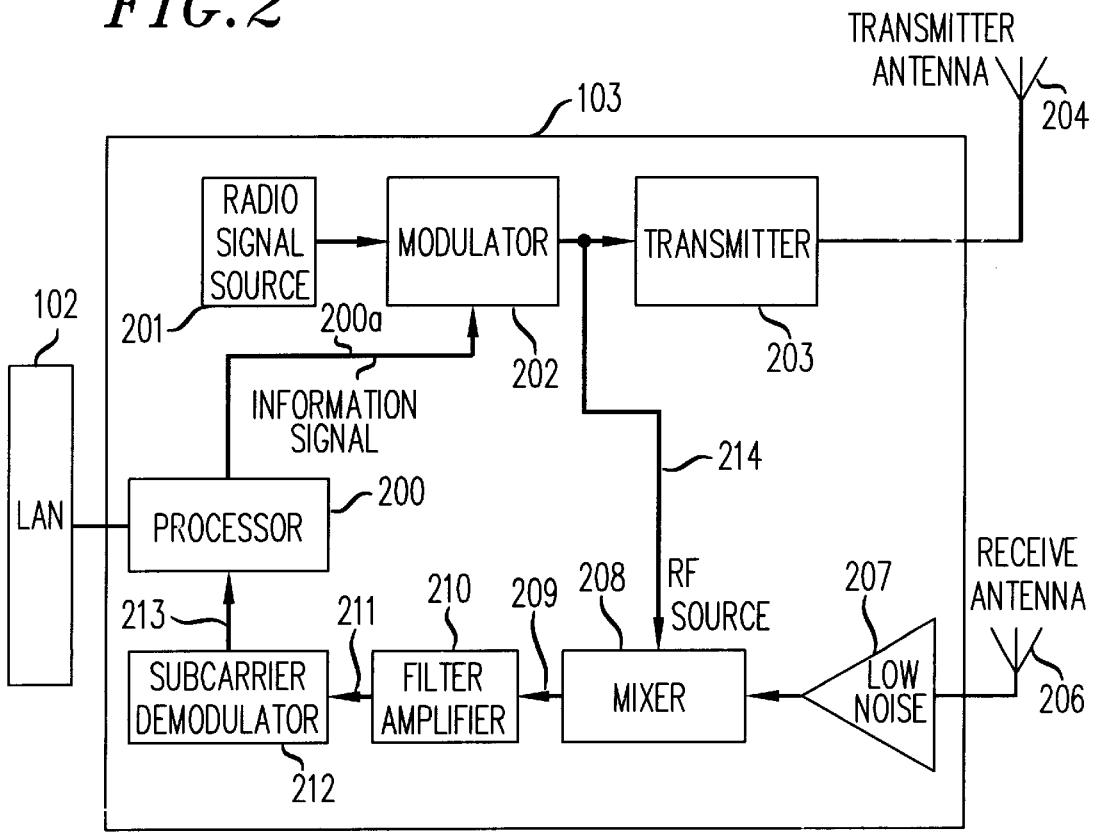
FIG. 2 is a block diagram of an illustrative interrogator unit used in the system of FIG. 1.

FIG. 2 illustrates a block diagram of an interrogator unit usable in the radio frequency identification system of FIG. 1. With joint reference next to both FIGS. 1 and 2, a radio signal source 201 generates a radio signal, the modulator 202 modulates a information signal 200*a* onto the radio signal, and a transmitter 203 sends this modulated signal via an antenna 204, illustratively using amplitude modulation, to a tag. Amplitude modulation is a common choice since a tag can demodulate such a signal with a single, inexpensive nonlinear device (such as a diode).

Figure 3:
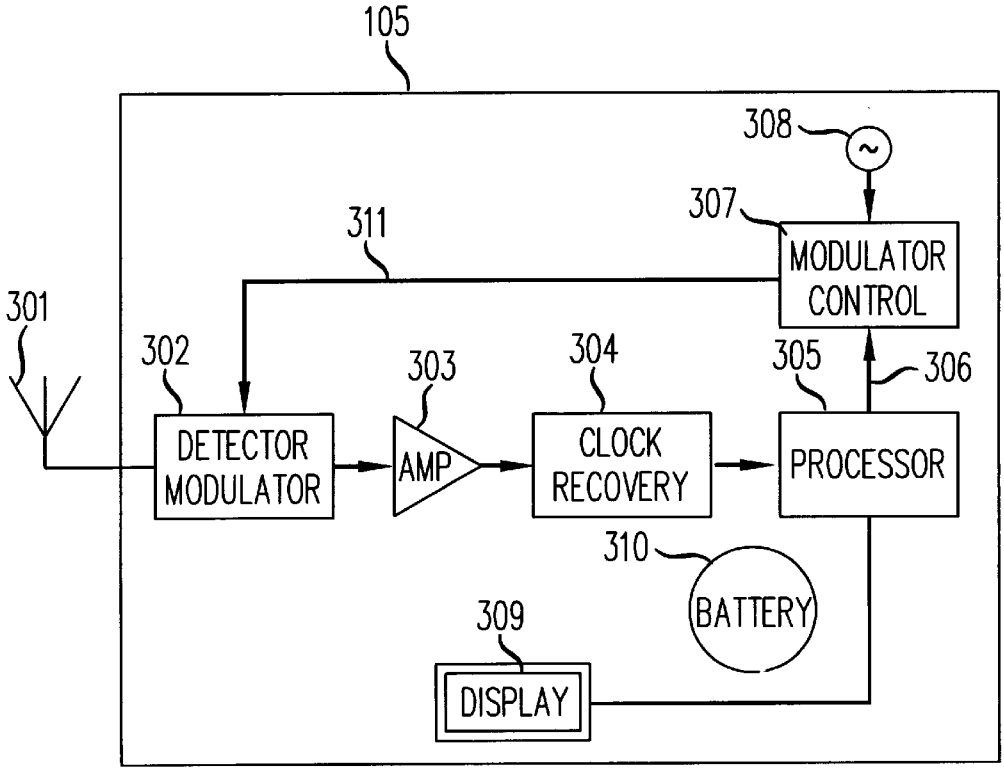
FIG. 3 shows a block diagram of a tag unit suitable for use in the radio frequency identification system of FIG. 1, in accordance with the invention.

FIG. 3 shows a block diagram of a tag unit usable in the radio frequency identification system of FIG. 1, in accordance with the disclosed embodiment of the invention. Although tag 105 is illustratively shown, the circuitry described therein is also present in tags 106 and 107. In the tag 105, the loop antenna 301 receives a modulated signal from one of the plurality of interrogators 103 or 104. This modulated signal is demodulated, directly to baseband, using a detector/modulator 302, which, illustratively, could be a single Schottky diode. The diode is appropriately biased with a proper current level in order to match the impedance of the diode and the antenna 301 so that losses of the radio signal are minimized. After the incoming signal is demodulated directly to baseband by the detector/modulator 302, the information signal is then amplified, by amplifier 303, and synchronization recovered in a clock and frame recovery circuit 304. The resulting information is sent to a processor 305 which also displays information about an inventory it is associated with in a display 309. The processor 305 is typically an inexpensive 4- or 8-bit microprocessor and includes read/write nonvolatile memory. The clock and frame recovery circuit 304 can easily be implemented in an ASIC (Application Specific Integrated Circuit) which works together with processor 305.

The processor 305 generates an information signal 306 to be sent from the tag 105 back to the interrogator (e.g., 103). This information signal 306 (under control of the clock and frame recovery circuit 304) is sent to a modulator control circuit 307, which uses the information signal 306 to modulate a subcarrier frequency generated by the subcarrier frequency source 308. The frequency source 308 may be a crystal oscillator separate from the processor 305, or it may be a frequency source derived from signals present inside the processor 305—such as a divisor of the primary clock frequency of the processor. The modulated subcarrier signal 311 is used by detector/modulator 302 to modulate the radio carrier signal received from tag 105 to produce a modulated backscatter (e.g., reflected) signal. This is accomplished by switching on and off the Schottky diode using the modulated subcarrier signal 311, thereby changing the reflectance of antenna 301. A battery 310 or other power supply provides power to the circuitry of tag 105.

The communication link of the RFID system is based upon the principle of modulated back scatter (MBS). There are a variety of techniques for using MBS to send information from the tag to the interrogator. In some MBS technologies, the modulator control circuit 307 of the tag 105, shown in FIG. 3, for example, generates an amplitude modulated signal modulated at an Information Signal 306 frequency $f_2$. If the radio signal source 201, shown in FIG. 2, generates a CW frequency $f_c$, then the interrogator receives signals a $f_c$ whose bandwidth is $2f_2$ and filters signals outside of this bandwidth range. This approach could be termed the "MBS at baseband" approach. Another approach would be for the tag 105 to generate a subcarrier frequency $f_s$, generated by frequency source 308, as shown in FIG. 3. The information could be conveyed using AM, FSK or Phase Shift Keying (PSK) by modulating the subcarrier frequency $f_s$ frequency source 308 with the Information Signal $f_2$ from the processor 306. The interrogator 103 receives signals at $f_c$, whose bandwidth is $2f_2$ but at a frequency $f_s$, away from $f_c$. This method is termed "MBS of a subcarrier". In Binary PSK (BPSK) systems, the phase of the subcarrier transitions nominally between 0 and 180 degrees.

Returning once again to FIG. 2, the interrogator 103 receives the reflected and modulated signal with the receive antenna 206, amplifies the signal with a low noise amplifier 207, and demodulates the signal using homodyne detection in a mixer 208 down to the intermediate frequency (IF) of the single subcarrier $f_s$. In some interrogator designs, a single transmitter 204 and receive 206 antenna is used. In this event, an electronic method of separating the transmitted signal from that received by the receiver chain is needed. This could be accomplished by a device such as a circulator. Using the same radio signal source 201 as used in the transmit chain means the demodulation to IF is done using homodyne detection. This has advantages in that it greatly reduces phase noise in the receiver circuits. The mixer 208 sends a demodulated signal 209—if using a quadrature mixer, it sends both I (in phase) and Q (quadrature) signals—into filter/amplifier 210 to properly filter the demodulated signal 209. The resulting filtered signal—then typically an information signal 211 carried on an IF subcarrier—is demodulated from the subcarrier in the subcarrier demodulator 212, which sends the information signal 213 to processor 200 to determine the content of the message. The I and Q channels of Signal 209 can be combined in the filter/amplifier 210, or in the subcarrier demodulator 212, or they could be combined in the processor 200.

Figure 4:
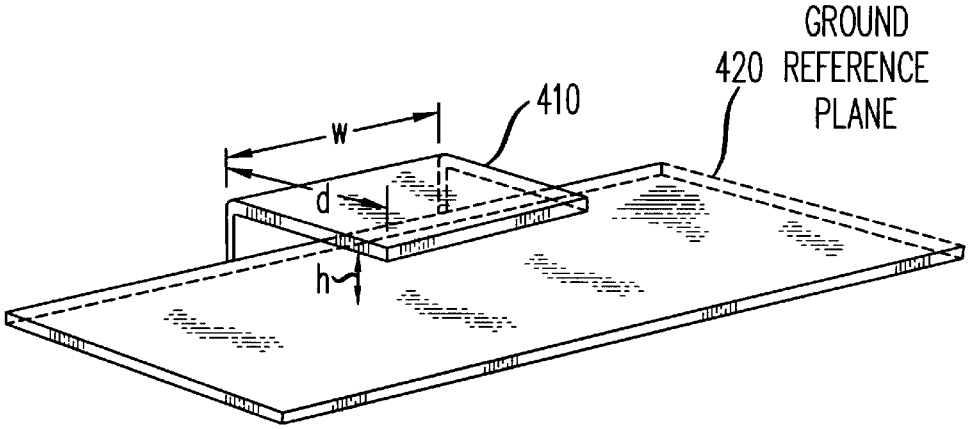
FIG. 4 shows a conceptual drawing of a quarter wave patch antenna, in accordance with the invention.

Referring next to FIG. 4, a quarter wave patch antenna is formed between two metallic plates 410 and 420, and the space between these plates filled with a dielectric material, which may be air or vacuum. The metallic plate 410 serves essentially as antenna 301 shown in FIG. 3. A direct metallic short is formed between the plate 401 and the plate 420 by a metal strip connecting the edges of these two plates. In the preferred embodiment, the dielectric material is a solid material with a high dielectric constant (>4) onto which the two metallic plates and the interconnecting path for these plates may be formed by standard photolithic and wet chemistry pattern and etch techniques. Examples of such materials are epoxy glass FR-4, teflon, or ceramic. The dimension "d" is determined to be one quarter of the wavelength of the radiating signal, modified by the dielectric constant of the substrate material. The bandwidth of this antenna is determined by the choice of substrate material and the separation "h" which is the spacing between the two metallic plates 410 and 420. By way of example, an antenna with a bandwidth of approximately 100 MHz may be constructed using a substrate material with a dielectric constant of 6, a carrier frequency of 2450 MHz, and antenna dimensions of h=2.54 mm, d=12.1 mm and w=15 mm.

Figure 5:
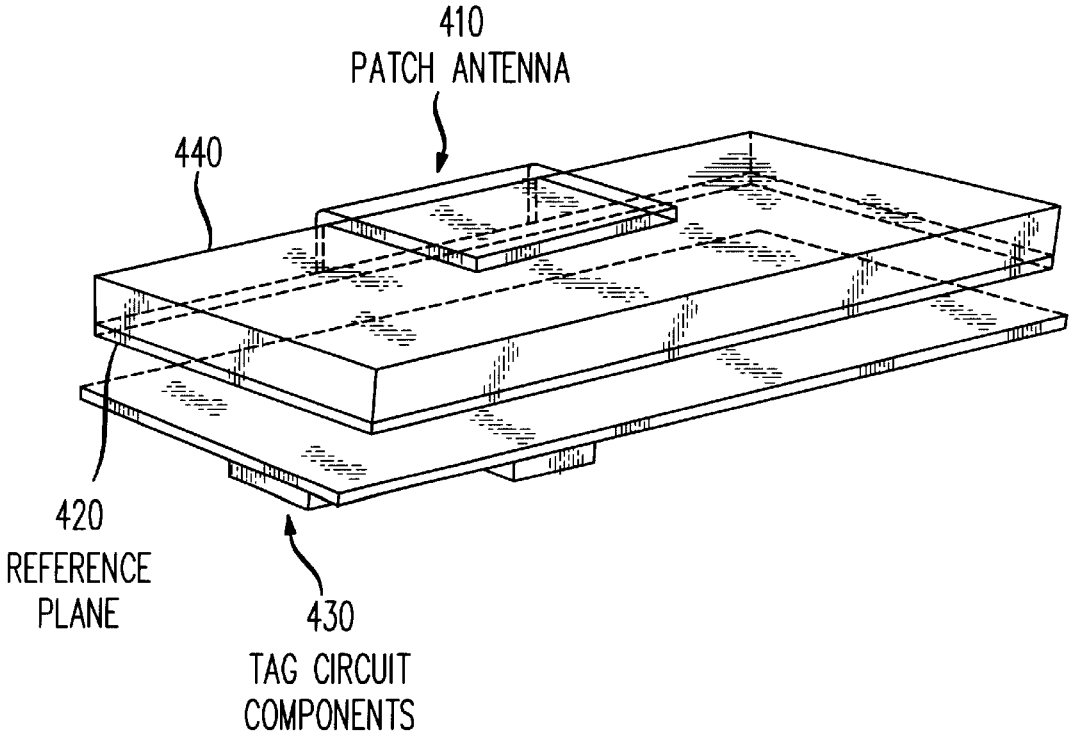
FIG. 5 shows a patch antenna configured with a circuit in a radio frequency identification tag, in accordance with the invention.

In FIG. 5 there is shown the assembly of the antenna with electronic components 430, which are part of the tag and also a dielectric substrate material 440. The circuit could be assembled on the same substrate as the antenna, or on a separate substrate, which minimizes the lateral dimensions of the tag. The entire assembly is encapsulated into a non-conducting material which protects the components from the environment and also provides mechanical stability for these tag components. For providing a particular application, the tag must be positioned such that electromagnetic radiation can impinge upon the tag surface which contains the patch antenna. The material or environment on the remaining 5 sides of the tag is relatively unimportant.

FIG. 6 illustrates an application of an RFID tag with a quarter wave patch antenna mounted on a cargo container rail 510. In this application, the tag is less than 28 mm wide, which is achieved with the quarter wave patch antenna design. The tag is embedded into an aluminum body, with the top surface of the tag (and antenna 410) flush with the top metal surface of the cargo container rail. There may or may not be a vertical metal surface (wall) adjacent to the tag location. The tag performance is not significantly modified by the presence or absence of this vertical reflecting surface, or by its relative position to the embedding rail, or by the absence of a metallic rail.

What has been described is merely illustrative of the application of the principles of the present invention. Other arrangements, substrate materials and antenna implementations and methods may be employed by those skilled in the art without departing from the spirit and scope of the present invention.

We claim:

1. A tag operating in a radio frequency identification system comprising:

an antenna for receiving a signal from at least one interrogator unit, said antenna including, a first metallic plate, a larger second metallic plate connected to said first metallic plate by a metallic conductor, said second metallic plate being spaced apart from and positioned parallel to said first metallic plate for providing a reference ground plane, and a substrate material is disposed between said first and second metallic plates; and tag electronic components assembled on said substrate material, said tag electronic components including, a detector/modulator for demodulating said signal, an amplifier to amplify the demodulated signal, a clock and frame recovery circuit to recover synchronization information from the amplified demodulated signal, and a processor to process the synchronization information and the amplified demodulated signal.

2. The tag as in claim 1 where said antenna is a quarter-wave patch antenna.

3. The tag as in claim 2 wherein a signal is radiated from and received by the first metallic plate.

4. The tag as in claim 3 wherein said first and second metallic plates are spaced apart by one-quarter of the wavelength of said signal, said one-quarter spacing being modified by a dielectric constant of said substrate material.

5. The tag as in claim 4 wherein the dimensions of said first metal plate are 12.1 millimeters by 15 millimeters.

6. The tag as in claim 5 wherein said one-quarter wavelength spacing is 2.54 millimeters.

7. The tag as in claim 6 wherein the dielectric constant of said substrate material is 6.

8. The tag as in claim 7 wherein the frequency of operation of said antenna is 2450 megahertz and the bandwidth is 100 megahertz.

9. A tag of the type operating in a radio frequency identification system and embedded in a cargo container rail, and communicating with an interrogator unit wherein the tag comprises:

a quarter-wave patch antenna for receiving a signal from said interrogator unit, said antenna including, a first metallic plate, a larger second metallic plate connected to said first metallic plate by a metallic conductor, said second metallic plate being spaced apart from and positioned parallel to said first metallic plate for providing a reference ground plane, a substrate material disposed between said first and second metallic plates, and tag electronic components assembled on said substrate material.

10. The tag as in claim 9 wherein a signal is radiated from and received by the first metallic plate.

11. The tag as in claim 10 wherein said first and second metallic plates are spaced apart by one-quarter of the wavelength of said signal, said one-quarter spacing being modified by a dielectric constant of said substrate material.

* * * * *